United States Patent [19]

Chandley

[11] Patent Number: 4,957,153

[45] Date of Patent: Sep. 18, 1990

[54] COUNTERGRAVITY CASTING APPARATUS AND METHOD

[75] Inventor: George D. Chandley, Amherst, N.H.

[73] Assignee: General Motors Corporation, Detroit, Mich.

[21] Appl. No.: 346,627

[22] Filed: May 2, 1989

[51] Int. Cl.[5] ..... B22C 9/04; B22D 18/06

[52] U.S. Cl. ..... 164/7.1; 164/34; 164/63; 164/160.1; 164/255

[58] Field of Search ..... 164/7.1, 7.2, 34, 35, 164/36, 63, 160.1, 160.2, 255

[56] References Cited

U.S. PATENT DOCUMENTS

| | | | |
|---|---|---|---|
| 3,059,294 | 10/1962 | Dunn et al. . | |
| 3,181,213 | 5/1965 | Schaible et al. . | |
| 3,557,867 | 1/1971 | Krzyzanowski | 164/225 |
| 3,581,802 | 6/1971 | Krzyzanowski | 164/34 |
| 4,085,790 | 4/1978 | Wittmoser | 164/7 |
| 4,340,108 | 7/1982 | Chandley et al. | 164/63 |
| 4,566,521 | 1/1986 | Uzaki et al. | 164/160.1 |
| 4,606,396 | 8/1986 | Chandley et al. | 164/255 |
| 4,616,689 | 10/1986 | Denis | 164/34 |
| 4,616,691 | 10/1986 | Voss | 164/255 |
| 4,658,880 | 4/1987 | Voss | 164/255 |
| 4,787,434 | 11/1988 | Cleary et al. | 164/34 |
| 4,848,439 | 7/1989 | Plant | 164/34 X |
| 4,874,029 | 10/1989 | Chandley | 164/34 |

OTHER PUBLICATIONS

Kubo, Y. et al., Molding Unbonded Sand With Vacuum-The V-Process; American Foundry Society Transactions No. 73-126, 1973, pp. 529-544.

*Primary Examiner*—Richard K. Seidel
*Assistant Examiner*—J. Reed Batten, Jr.
*Attorney, Agent, or Firm*—Reising, Ethington, Barnard, Perry & Milton

[57] ABSTRACT

In an apparatus for vacuum countergravity casting of molten metal, a gas permeable, self-supporting mold is supported in an inverted casting position in an open bottom container with a particulate bed compacted about the mold. The mold may comprise a mold stack having a plurality of mold members stacked side-by side to form a plurality of mold cavities therebetween. The particulate bed may comprise loose, unbonded particulate compacted in-situ about the mold to support the mold stack in the container and press the mold members sealingly together before, during and after filling with molten metal.

55 Claims, 8 Drawing Sheets

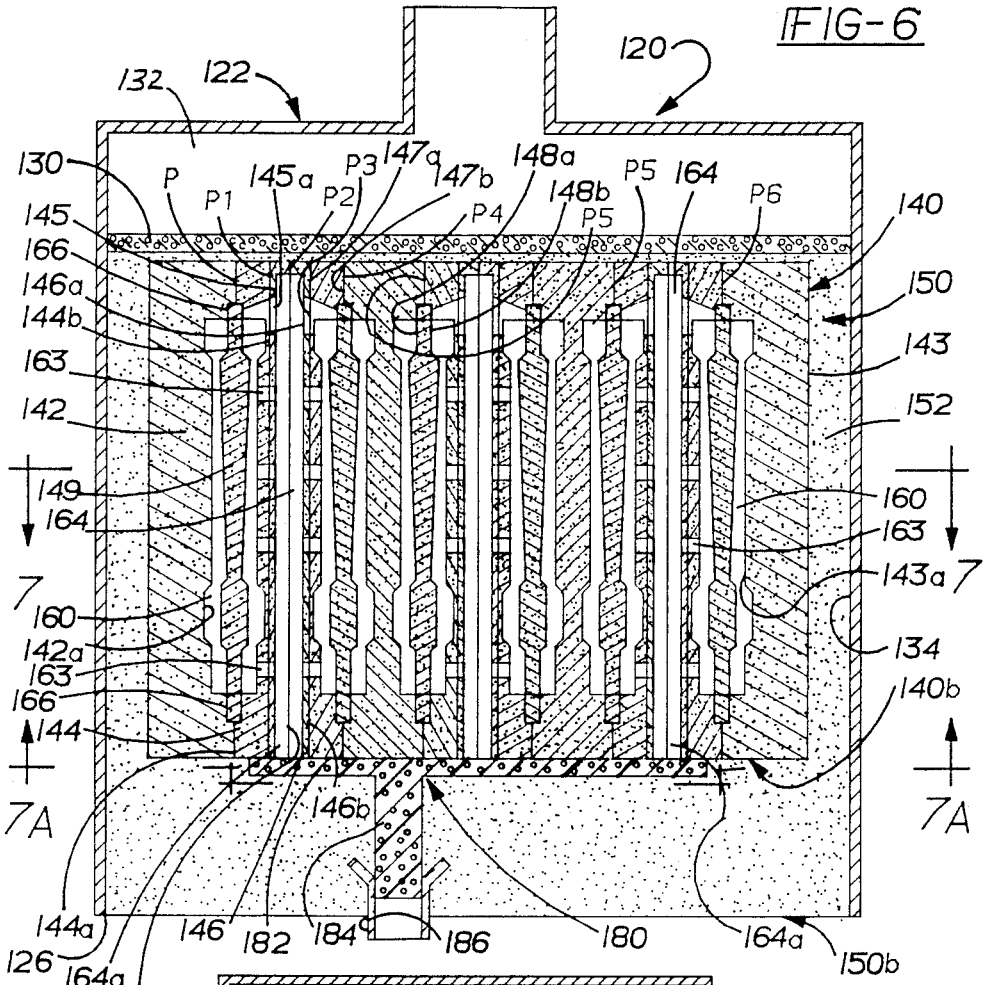
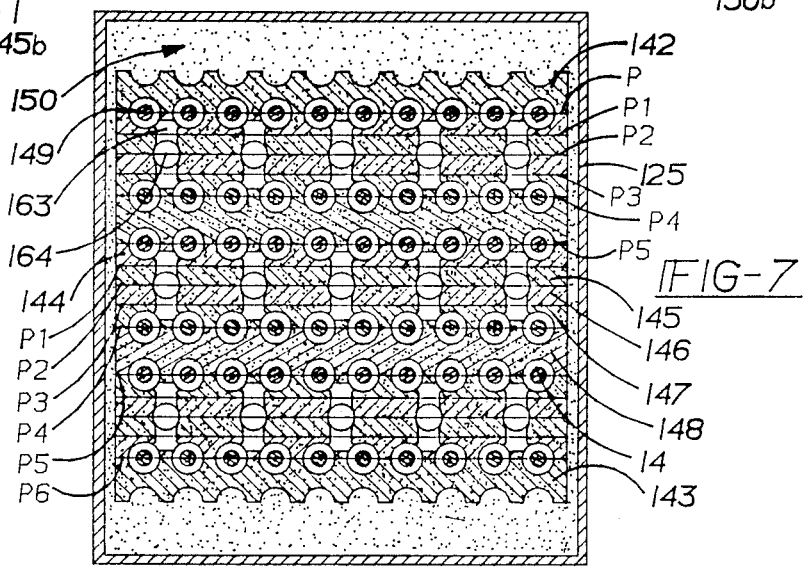
FIG-7

VACUUM PUMP
36

38
20
24
32
22
25
50a
P2
P3
46b
64
P2
P3
P2
64
R
P1
45a
46a
P1
45
46
44
P1
30
P1
40
P4
66
66
42a
42b
25
46
43a
402
401
402
401
400
400
60
50
44
14
34
44a
60
47
26
25a
50a
50b
44b
45b
66
62
40b
13
62
40a
10
66
13
12

COUNTERGRAVITY CASTING APPARATUS AND METHOD

FIELD OF THE INVENTION

This invention relates to the countergravity casting of molten metal into a gas permeable, self-supporting mold and, more particularly, to a method and apparatus of countergravity casting using a gas permeable, self-supporting mold disposed in an inverted casting position in an open bottom container with a particulate bed compacted about the mold.

BACKGROUND OF THE INVENTION

A vacuum countergravity casting process using a gas permeable, self-supporting mold sealingly received in a vacuum housing is described in such patents as the Chandley et al U.S. Pat. Nos. 4,340,108 issued July 20, 1982 and 4,606,396 issued Aug. 19, 1986. That countergravity casting process involves providing a mold having a porous, gas permeable upper mold member (cope) and a lower mold member (drag) sealingly engaged together at a horizontal parting plane, sealing the mouth of a vacuum housing to a surface of the mold such that a vacuum chamber formed in the housing confronts the gas permeable upper mold member, submerging the bottom side of the lower mold member in an underlying molten metal pool and evacuating the vacuum chamber to draw molten metal through one or more in gate passages in the lower mold member and into one or more mold cavities formed between the upper and lower mold members.

The mold and the vacuum housing typically are sealed together using a gasket seal compressed between the bottom lip of the vacuum housing and an upwardly facing sealing surface or flange formed on the mold, either on the lower or upper mold member. Various mechanical clamping mechanisms have been provided for clamping the vacuum housing and the mold together to compress the seal therebetween; e.g., as shown in U.S. Pat. Nos. 4,340,108; 4,616,691 and 4,658,880.

The need for such mold-to-vacuum housing sealing systems complicates the casting apparatus as well as the casting mold. In this latter regard, the mold must include the sealing surface/flange needed to cooperate with the gasket seal and oftentimes attachment features, such as threaded lugs, needed to cooperate with the mechanical clamping mechanism. Moreover, the need for such mechanical sealing systems limits to some extent the variety of mold designs which can be used with the system.

In the countergravity casting process described in the aforementioned patents, the lower and upper mold members typically are engaged at a horizontal parting plane therebetween. Engagement of the lower and upper mold members at the parting plane is effected in such a manner as to substantially prevent or minimize leakage of molten metal from the mold cavity at the parting plane during casting since molten metal leakage can result in the production of unacceptable castings and damage to the vacuum housing and associated vacuum components of the casting apparatus. To this end, the lower and upper mold members are often adhered (e.g., glued) together at the horizontal mold parting plane. The gluing process for sealingly engaging the upper and lower mold members together is expensive and time consuming and elimination thereof would improve the efficiency and economies of the vacuum countergravity casting process.

In practicing the aforementioned vacuum countergravity process, the mold is subjected to flexural and other stresses when the vacuum chamber confronting the upper mold member is evacuated and the molten metal is drawn upwardly into the mold cavity. The thickness and thus the strength of the walls of the casting mold must be sufficient to withstand these and other stresses imposed on the mold during casting to prevent cracking or total fracture of the mold and resultant molten metal leakage from the mold cavity into the vacuum chamber. A reduction in both the thickness of the mold walls and the outside structural features needed for sealing to the mouth of the vacuum chamber would reduce the amount of expensive resin-bonded sand employed in the mold and also improve the economies of the casting process. Moreover, without such excess mold material and structural features, more of the volume of the vacuum chamber would be available to accommodate more molds and hence increase the number of castings possible per casting cycle for a given size vacuum chamber.

It is an object of this invention to provide an improved, economical countergravity casting apparatus and process using a gas permeable, self-supporting mold (e.g., a resin-bonded sand mold) which does not require a mechanical mold-to-vacuum housing sealing/clamping system.

It is another object of this invention to provide an improved, economical countergravity casting apparatus and process using a gas permeable, self-supporting mold wherein the amount of costly resin-bonded mold particulate (e.g., resin-bonded sand) required for the mold is substantially less than heretofore required.

It is another object of this invention to provide an improved, economical countergravity casting apparatus and process using gas permeable, self-supporting molds wherein more molds/mold cavities are possible per given size vacuum chamber than heretofore possible, thereby resulting in substantially increased productivity and economies.

It is a further object of the invention to provide such an improved, economical countergravity casting apparatus and process wherein a gas-permeable, self-supporting mold is disposed in an open bottom container with a particulate bed compacted about the mold and wherein the mold and the particulate bed are subjected to a negative differential pressure in the container in such a manner as to hold the particulate bed about the mold and preferably also hold the mold in an inverted casting position in the container before, during and after filling with the molten metal.

It is a further object of the invention to provide an improved, economical countergravity casting apparatus and process using a gas permeable, self-supporting mold which includes a plurality of mold members stacked side-by-side and configured at parting planes therebetween to provide a significantly increased number of mold cavities available for casting per mold.

It is still another object of the invention to provide an improved, economical countergravity casting apparatus and process of the preceding paragraph wherein the mold members are held in stacked side-by-side relation in such a manner as to eliminate the need to glue the mold members together at the parting planes therebetween.

SUMMARY OF THE INVENTION

The invention contemplates an apparatus for countergravity casting of molten metal wherein the apparatus includes a container having an open bottom end, a gas permeable, self-supporting mold disposed in the container and having a mold cavity and molten metal inlet means communicating the mold cavity with the underside of the mold for admitting the molten metal into the mold cavity from an underlying molten metal pool; a particulate bed compacted in the container about the mold and means for establishing a negative differential pressure between the inside and the outside of the container sufficient to hold the particulate bed in the container about the mold before, during and after filling of the mold cavity with the molten metal. Preferably, the negative differential pressure between the inside and the outside of the container so coacts with the particulate bed as to support the mold in the container before, during and after filling of the mold cavity with the molten metal. After molten metal is cast into the mold cavity at a casting station, the metal-filled mold is moved to a mold discharge station where elimination of the differential pressure permits the mold and the particulates to fall free of the container. The means for establishing the negative differential pressure will preferably comprise means for evacuating the container (e.g., a vacuum pump).

The particulate bed will preferably comprise loose, unbonded particulates (e.g., loose, binderless foundry sand) compacted in the container about the mold by the differential pressure established between the inside and the outside of the container. However, bonded particulates (e.g., green sand) may be substituted for the loose, unbonded particulates in practicing the invention.

The invention also contemplates a method of countergravity casting wherein a gas permeable, self-supporting mold is positioned in an open bottom container such that molten metal inlet means of the mold communicates a mold cavity with the underside of the mold, a particulate bed surrounds the mold in the container and a negative differential pressure is established between the inside and the outside of the container in such a manner as to hold the particulate bed about the mold which is in an inverted casting position in the container during the countergravity casting process when the open container end faces an underlying molten pool.

In one embodiment of the invention, the mold comprises a plurality of gas permeable, self-supporting mold members held stacked side-by-side together in the container by various means. In one embodiment of the invention, the mold members can be held stacked side-by-side by adhering the mold members together at parting planes therebetween. In another embodiment, the mold members can be pressed together from the exterior thereof in such a manner as to maintain the mold members in stacked side-by-side relation. Preferably, the mold members are held in stacked side-by-side relation by the particulate bed that is compacted in-situ about the mold stack. The mold members may form a plurality of vertical or horizontal parting faces therebetween when they are held stacked side-by-side in the container. The parting faces may be formed with a plurality of mold cavities therebetween in such a manner as to increase the number of castings which can be produced per mold stack. The particulate bed compacted about the mold stack substantially prevents leakage of molten metal out of the parting planes between the mold members when the mold cavities formed therebetween are filled with the molten metal.

BRIEF DESCRIPTION OF THE DRAWINGS

FIG. 6 is a sectioned elevational view of a mold assembly of another embodiment of the invention.

FIG. 7 is a sectional view taken along lines 7—7 of FIG. 6.

DESCRIPTION OF CERTAIN EMBODIMENTS OF THE INVENTION

Figure 1:
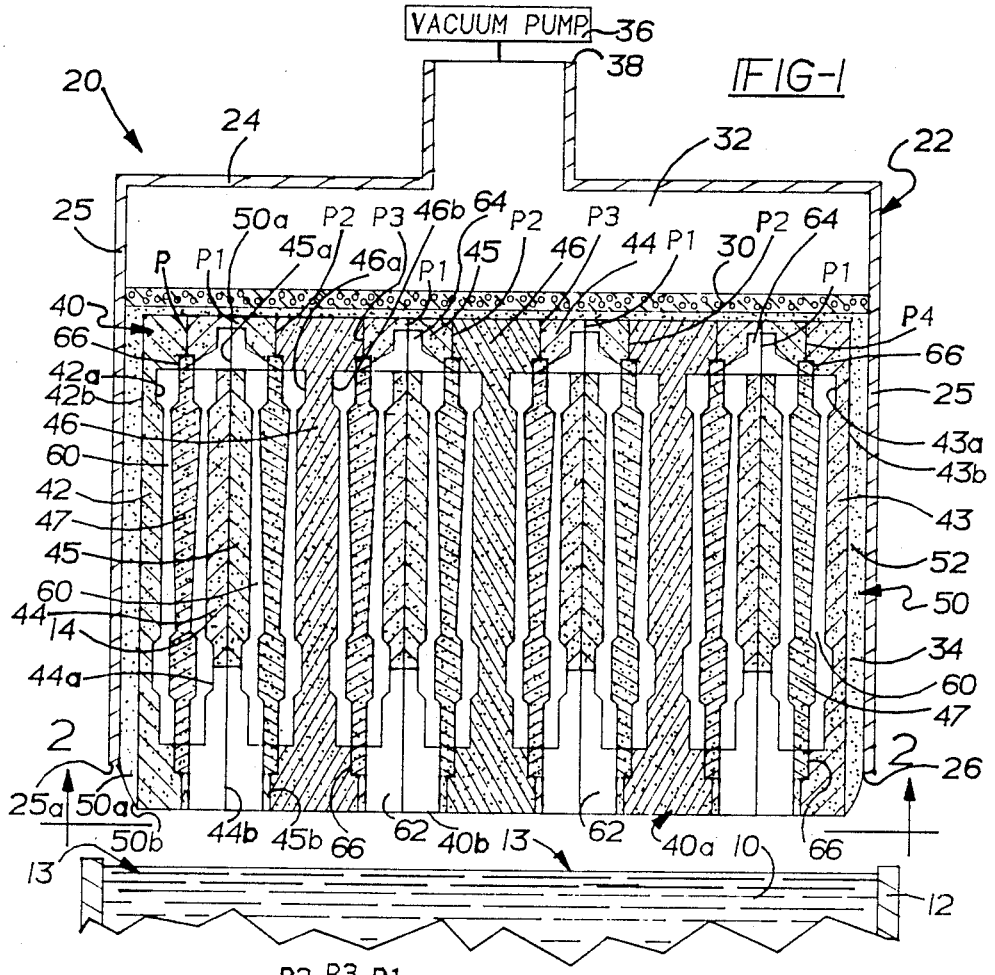
FIG. 1 is a sectioned elevational view of one embodiment of a vacuum countergravity casting apparatus in accordance with the invention.

FIG. 1 illustrates a casting apparatus in accordance with one embodiment of the invention for vacuum countergravity casting the molten metal 10 in a vessel 12 into a mold assembly 20. The mold assembly 20 includes a container 22 having an end wall 24 and a peripheral side wall 25 terminating in a lip **25*a* (see FIG. 3) that defines an open end 26 of the container 22. A gas permeable, particulate barrier or septum 30 (e.g., a porous ceramic plate) is disposed generally horizontally in the container 22 between the peripheral side wall 25 to form an upper vacuum chamber 32 (i.e., when viewed in the casting position) and a lower chamber 34 in the container 22. The upper vacuum chamber 32 is communicated by a conduit 38 to a vacuum pump 36 of the casting apparatus. When the upper chamber 32 is evacuated, the lower chamber 34 is evacuated through the gas permeable particulate barrier 30**.

A mold stack 40 is supported in an inverted casting position in the lower chamber 34 by an inherently unstable bed 50 of loose, unbonded particulate material 52 (e.g., dry foundry sand) that is compacted in-situ in the lower chamber 34 about the mold stack 40 as will be more fully explained hereinbelow. The loose, unbonded sand bed 50 is inherently unstable in that it comprises a mass of unbonded, or weakly bonded, particulates which, in the context of the present invention, has insufficient internal cohesive strength to, by itself (i.e., without the aforesaid external-internal fluid pressure differential), support its own weight and that of the mold stack 40 as well as that of the casting ultimately formed therein during the casting process.

The mold stack 40 comprises a plurality of gas permeable, self-supporting, relatively thin plate-like mold members 42,43,44,45,46 stacked side-by-side and sealingly engaged at vertical parting planes P–P4 therebetween. The mold members 42 and 43 are disposed outboard of the intermediate mold members 44,45,46 which are arranged in repeating sequence between the end mold members 42 and 43 as shown. Self-supporting cores 47, which may be gas permeable or impermeable, are positioned at the parting planes P, P2, P3 and P4.

The stacked mold members 42–46 and cores 47 define at the parting planes P–P4 a plurality of annular mold cavities 60 to receive molten metal from slot-shaped molten metal inlet passages 62 and risers 64. The risers 64 have uppermost ends **64*a* that are typically cylindrical in shape. As is apparent from FIGS. 1 and 2, each inlet passage 62 interconnects a set of two adjacent mold cavities 60 at the lower end thereof to supply the molten metal 10 thereto from the molten metal pool 13. Similarly, each riser 64 interconnects a set of two adjacent mold cavities 60 at the upper end thereof to provide a source of molten metal to these mold cavities as the metal solidifies therein. Core prints 66 are also defined at the parting planes P–P4 to receive and align opposite ends of each core 47. The mold members 42,43 each include a respective inner parting face 42*a*,43*a* and a respective outer end face 42*b*,43*b* that define outboard ends of the mold stack 40. The mold members 44,45,46 each include respective first and second parting faces 44*a*,44*b*; 45*a*,45*b* and 46*a*,46*b*. It is apparent that the parting faces 42*a*; 43*a*; 44*a*,44*b*; 45*a*,45*b*; and 46*a*,46*b* are contoured or shaped to include portions of the mold cavities 60, inlet passages 62, risers 64 and core prints 66 such that when these parting faces are sealingly abutted to form parting planes P–P4, complete mold cavities 60, inlet passages 62, risers 64 and core prints 66** are formed therebetween.

The mold members 42–46 can be made of resin-bonded sand in accordance with known practice wherein a mixture of sand or equivalent particles and bonding material is formed to shape and cured or hardened against contoured metal pattern plates (not shown) having the desired complementary contour or profile to form the parting faces with portions of the mold cavities 60, the inlet passages 62, risers 64, core prints 66 and other features shown. The bonding material may comprise inorganic or organic thermal or chemical setting plastic resin or equivalent bonding material. The bonding material is usually present in a minor percentage of the mixture, such as about 5% by weight or less of the mixture. The cores 47 can also be made of resin-bonded sand in accordance with known core box procedures.

The mold stack 40 is assembled by stacking the mold members 42–46 in side-by-side relation at the parting planes P–P4 with the cores 47 therebetween. The mold members 42–46 are temporarily held in such stacked side-by-side relation by suitable fixturing means, such as an exterior clamp 49 (shown schematically in FIG. 3) having fingers **49*a* for engaging the outer end faces 42*b*,43*b* of the mold members 42,43 and holding the mold members 42–46 together (without glue) at the parting planes P–P4. Various fixturing means can be used to hold the mold members 42–46 in stacked side-by-side relation; e.g.; a sheet or strap of material, such as a disposable plastic sheet or a steel strap (not shown), can be tightly wrapped about the mold stack 40 to this end. The fixturing means may remain with the mold stack 40 throughout the casting process if desired. For example, the mold members 42–46** may be bolted or strapped together throughout the casting process, if desired.

Figure 3:
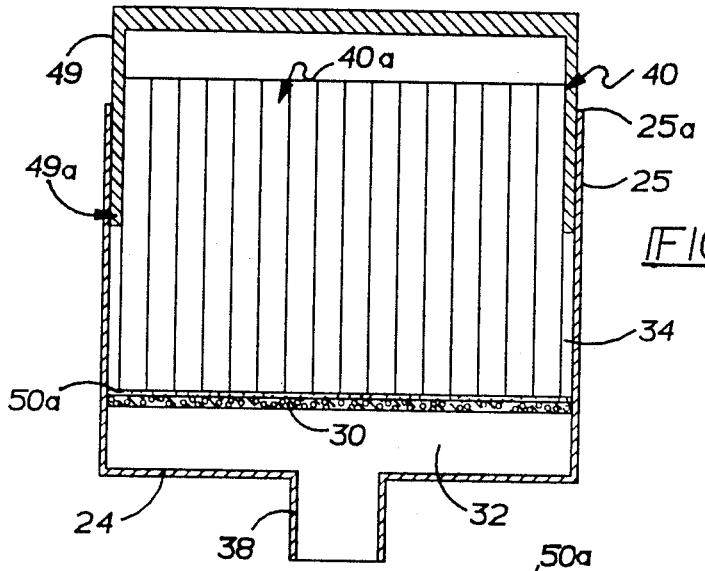
FIG. 3 is an elevational view of the mold stack positioned in the container, shown in section, with the container partially filled with particulate.

As best shown in FIG. 3, the mold stack 40 is then placed on a layer **50*a* of loose, unbonded particulate material 52 deposited on the gas permeable, particulate barrier 30 of the container 22, which is oriented with its open end 26 facing upwardly. The mold stack 40 is placed on the layer 50*a* with the risers 64 disposed adjacent the particulate barrier 30 and the inlet passages 62 disposed slightly above the open end 26 of the container 22. Loose, unbonded particulate material 52 is then introduced between the mold stack 40 and the peripheral side wall 25 to a height sufficient to maintain the mold members 42–46 in stacked side-by-side relation at parting planes P–P4. If used, the clamp fingers 49*a* are then removed from engagement with the mold stack 40 and from the chamber 34. Thereafter, additional loose, unbonded particulate material 52 is introduced between the mold stack 40 and the peripheral wall 25 to the upper level of an annular extension 67 temporarily set atop the end lip 25*a* of the peripheral wall 25, FIG. 4. The container 22 may be vibrated during the introduction of the particulates for effecting optimum initial packing thereof about the mold stack 40**.

After the particulate material 52 is introduced to the level of the annular extension 67, the vacuum chamber 32 is evacuated to establish a negative differential pressure between the inside and the outside of the particulate-filled chamber 34. The level of vacuum drawn in the chamber 34 is selected sufficient to compact the particulate bed 50 in-situ in the chamber 34 about the mold stack 40 to such an extent that, upon inversion of the mold assembly 20 (FIG. 1), the mold stack 40 is supported in the lower chamber 34 and the mold members 42–46 are pressed sealingly together across the parting planes P–P4, before, during and after filling of the mold cavities 60 with the molten metal 10. In effect, the particulate bed 50 is caused by the negative differential pressure to compressively embrace the mold stack 40 and so coact with the negative differential pressure applied between the inside and outside of the chamber 34 as to solely support and press the mold stack 40 (i.e., mold members 42–46) together in the chamber 34 without the need for a separate mechanism to support the mold stack 40 in the chamber 34, although the invention is not so limited. The compressive action of the particulate bed 50 on the mold stack 40 (i.e., pressing the members 42–46 sealingly together across the parting planes P–P4) before, during and after filling of the mold cavities 60 with molten metal eliminates the need to glue the mold members 42–46 together at the parting planes P–P4.

The amount of vacuum required will vary with the height and weight of the mold stack 40 and the particulate bed 50, the size (e.g., mesh size) of the particulate material 52, the amount of metal 10 to be cast into the mold stack 40 and, to some extent, the area of the open end 26 of the container 22. The size of the loose, unbonded particulate material 52 is controlled so as to prevent its falling out of the open end 26 of the container on the one hand and being drawn into the particulate barrier 30 on the other hand. For a particular round silica sand particulate commonly used in casting iron and steel, particle sizes less than about 40 mesh AFS and larger than about 90 mesh AFS have proved satisfactory. A more preferred range of such sand particle sizes is about 50 mesh AFS to about 70 mesh AFS. The particular range of particle sizes useful for a particular application will depend on the type and shape of the particulate material 52 used, the pore size of the particulate barrier 30 and the vacuum level established in the upper chamber 32. When the particulate bed 52 comprises bonded particulate such as bonded sand, smaller particle sizes are preferred for casting metals having higher melting points.

The size of the loose, unbonded particulate material 52 can also be varied at different locations in the bed 50 to enhance the negative differential pressure between the inside and the outside of the particulate-filled chamber 34 for a given level of vacuum maintained in chamber 32. For example, larger particles 52 can be used adjacent the particulate barrier 30 while smaller (finer) particles can be used adjacent the open end 26 of the container 22.

After the required vacuum is drawn in the upper and lower chambers 32,34, the extension 67 is removed from the peripheral wall 25 for reuse or disposal. Removal of the extension 67 leaves outermost portions **40*a* and 50*a* of the mold stack 40 and the particulate bed 50 in proximity to and projecting beyond the open end 26 of the container 22 (FIG. 1**) for purposes to be explained.

After removal of the annular extension 67, the mold assembly 20 is inverted (i.e., rotated about a horizontal axis) by suitable means (not shown) connected to the container 22 to orient the open end 26 and the outermost portions **40*a*,50*a* of the mold stack 40 and the particulate bed 50 in a downwardly facing orientation. A sheet of aluminum foil, plastic or other material of reduced gas permeability may be positioned on the bottom of the mold stack 40 and the particulate bed 50. The sheet is subsequently destroyed/removed when the bottom of the mold stack 40 is immersed in the molten metal pool 13**.

The inverted mold assembly 20 is then moved above the molten metal pool 13 (formed by the molten metal 10 in the container 12) to position the mold stack 40 in an inverted casting position above the pool 13, FIG. 1.

Figure 4:
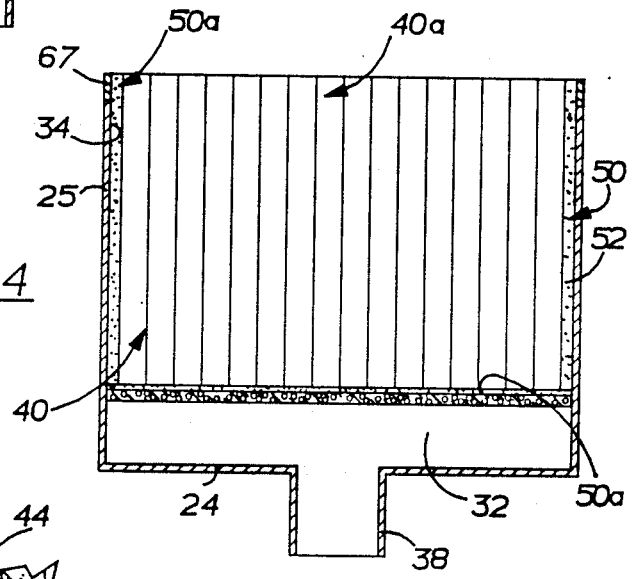
FIG. 4 is similar to FIG. 3 with the container filled with particulate beyond the mouth thereof and to a level formed by a temporary extension placed thereon.

In lieu of introducing the particulate material 52 about the mold stack 40 in the inverted container 22 as shown in FIGS. 3 and 4, (i.e., with open end 26 facing upwardly), the particulate material 52 can be simply vacuumed upwardly into the container 22 about the mold stack 40 with the open end 26 facing downwardly. For example, the mold stack 40 is first set on a bed of the particulate material 52 with the molten metal inlet passages 62 facing downwardly and the container 22 with its open end 26 facing downwardly is lowered around the mold stack 40. The vacuum chamber 32 is then evacuated sufficiently to draw the loose particulate material 52 upwardly into the chamber 34 of the container 22 about the mold stack 44. After sufficient particulate material 52 is drawn into the chamber 34 about the mold stack 40, the container 22 with the mold stack 40 and the particulate bed 50 therein is lifted upwardly from the bed of particulate material 52 with the vacuum maintained in chamber 32. A sheet of aluminum foil may optionally then be placed on the bottom of the mold stack 40 and the particulate bed 50 as mentioned hereinabove. The mold assembly 20 formed can then be moved to a position above the molten metal pool 13 for casting. As is apparent, this technique for introducing the particulate material 52 into the chamber 34 about the mold stack 40 eliminates the need to invert the container during the formation of the mold assembly 20.

It is apparent from FIG. 1 that the vacuum applied in the chambers 32,34 must be at least sufficient to draw molten metal upwardly into the risers 64 during the casting step and to exert an upward force on the bottom sides **40*b*,50*b* of the mold stack 40 and the particulate bed 50, respectively, which is at least equal to the combined weight of the mold stack, the particulate bed and the metal which will be cast into the mold stack. A vacuum level in the upper chamber 32 of about 10 inches of mercury and above has been used to successfully hold a resin-bonded sand mold stack 40 (about 700 lbs.) in the inverted casting position (FIG. 1) in a binderless silica sand particulate bed 50 (about 800 lbs. and about 67 mesh AFS particle size) before, during and after filling the mold cavities 60 with molten metal (about 57 lbs.) without the mold stack 40 or particulate 52 falling out of the open end 26 (circular opening 30 inches in diameter) and without the need for a separate mechanism to support the mold stack in the chamber 34. Such a vacuum level in the upper chamber 32 has been found to produce a vacuum gradient in the particulate bed 50 such that the vacuum level is greater adjacent the particulate barrier 30 than adjacent the open end 26. For example, a vacuum level of about 0.4 inch of mercury has been measured in the particulate bed 50 at a location one half inch inwardly of the open end 26 of the container 22 while a vacuum level of 6 inches of mercury has been measured in the bed 50 at a location 5.8 inches inwardly of the open end 26**.

Referring to FIG. 1, the countergravity casting process of the invention is carried out by relatively moving the mold assembly 20 and the molten metal pool 13 to immerse the portions **40*a*,50*a* of the mold stack 40 and the particulate bed 50 in the molten metal pool 13 to expose inlet passages 62 directly to the pool 13 while the upper and lower chambers 32,34 are evacuated as described hereinabove. Typically, the mold assembly 20 is lowered toward the pool 13. Since subatmospheric pressure is provided in the upper and lower chambers 32,34 while atmospheric pressure is exerted on the pool 13 during such immersion, the molten metal 10 is urged upwardly through inlet passages 62 and into the mold cavities 60 and risers 64 to fill them with the molten metal 10**.

Figure 5:
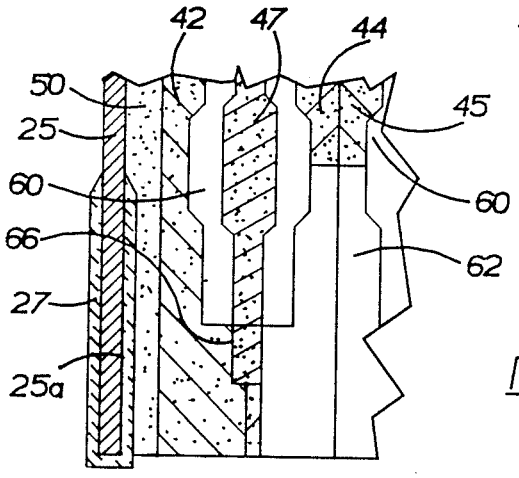
FIG. 5 is a partial, sectioned elevational view of another embodiment of a vacuum countergravity casting apparatus in accordance with the invention.

As mentioned hereinabove, the portions **40*a*,50*a* of the mold stack 40 and the particulate bed 50 extend beyond the open end 26 of the container 22. This feature permits immersion of these portions 40*a*,50*a* in the underlying molten metal pool 13 without having to submerge any part of the peripheral wall 25 of the container 22 therein during the casting operation. However, it is not essential that the portions 40*a*,50*a* of the mold stack 40 and the particulate bed 50 project beyond the open end 26. As shown in FIG. 5, the lip 25*a* of the peripheral wall 25 and the portions 40*a*,50*a* of the mold stack 40 and the particulate bed 50 may be generally coextensive such that all are immersed in the underlying pool 13 to carry out the casting process. In this situation, the lowermost portion of the peripheral wall 25 can be coated with a layer 27 of material, such as ceramic, which is resistant to the heat and destructive effects of the molten metal 10. Alternatively, the lowermost portion of the peripheral wall 25 may include a ceramic lip attached thereon for immersion in the molten metal pool 13 during the casting operation; e.g., see lip 326 of FIG. 10**.

After solidification of the molten metal 10 in the mold stack 40, the mold assembly 20 is raised to withdraw the portions 40*a*,50*a* of the mold stack 40 and the particulate bed 50 out of the pool 13. During this operation, the vacuum is maintained in the upper and lower chambers 32,34 to so coact with the particulate bed 50 as to support and sealingly press the metal-filled mold stack 40 (i.e., mold members 42–46) together in the lower chamber 34.

Alternatively, for casting certain large size castings, the mold assembly 20 may be raised away from the pool 13 after initial solidification of the molten metal in the inlet passages 62 while the molten metal in the mold cavities 60 is still molten. The number and size of the inlet passages 62 to achieve metal solidification at the inlet passages 62 will vary with the type of the article to be cast and the particular metal to be cast as explained in U.S. Pat. No. 4,340,108, the teachings of which are incorporated herein by reference.

Alternatively, the mold assembly 20 may be raised away from the pool 13 immediately after filling the mold cavities 60 and the risers 64 with the molten metal 10 and prior to solidification of the molten metal in the inlet passages 62 while maintaining the vacuum in chambers 32,34. In this embodiment of the invention, the inlet passages 62 are constricted in size to such an extent as to coact with the differential pressure maintained on the molten metal in the mold stack 40 to hold the molten metal in the inlet passages 62 as well as mold cavities 60 thereabove after removal from the pool 13. Typically, the molten metal will solidify rapidly in the inlet passages 62 (e.g., within 30 seconds) after removal of the mold stack 40 from the pool 13. The solidified metal in the inlet passages 62 thereafter prevents run-out of the molten metal in the mold cavities 60.

Following withdrawal of the metal-filled mold assembly 20 from the pool 13 and solidification of the molten metal therein, the mold assembly 20 is transferred to an unloading station where the open end 26 of the container 22 is oriented to face downwardly. The vacuum in upper chamber 32 is then released at the unloading station to provide atmospheric pressure in chambers 32,34. This equalization of the pressure inside and outside the container 22 causes the metal-filled mold stack 40 and the particulate bed 50 to fall by gravity out of the container 22 through the open end 26 for separation of the castings from the mold stack 40 and the particulate bed 50.

In the embodiment of the invention described hereinabove, the mold members 42–46 of the mold stack 40 are described as being sealingly pressed together across the vertical parting planes P–P4 solely by the compressive action of the particulate bed 50 on the mold stack 40. If desired, the mold members 42–46 may be glued together at the parting planes P–P4 to sealably join them together. Alternatively, a peripheral clamping member, strap or band (not shown) may be disposed and tightened exteriorly around the mold stack 40 to mechanically press the mold members 42–46 together across the vertical parting planes P–P4 from the exterior of the mold stack 40 during the casting process. Those skilled in the art will appreciate that other means may be employed to this end. For example, a plurality of fasteners, such as bolts, may extend through the mold members 42–46 for holding and pressing the mold members 42–46 together across the vertical parting planes of the mold stack 40.

FIGS. 6 and 7 illustrate another embodiment of the invention employing a somewhat different mold stack 140 from that described hereinabove with respect to FIGS. 1–5. The mold stack 140 includes a plurality of gas permeable, self-supporting mold members 142,143,144,145,146,147,148 (e.g., resin-bonded sand) stacked side-by-side and sealingly engaged at vertical parting planes P–P6. Cores 149 (e.g., similar to those shown in FIGS. 1 and 2) are disposed at the parting planes P, P4, P5 and P6. The parting faces 142*a*; 143*a*; 144*a*,144*b*; 145*a*,145*b*; 146*a*,146*b*; 147*a*,147*b* and 148*a*,148*b* of the mold members are configured to define multiple groups of four annular mold cavities 160 as well as a plurality of lateral in gate passages 163, riser passages 164 and core prints 166 when the parting faces are sealingly abutted to form parting planes P–P6. Each group of four mold cavities 160 is filled with molten metal from a common riser passage 164 through the lateral in gate passages 163 located between each riser passage 164 and each group of four mold cavities 160.

Figure 7A:
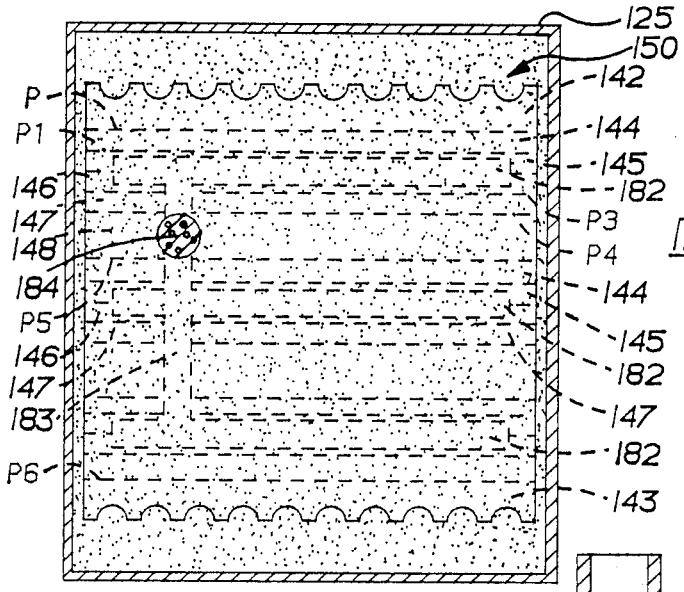
FIG. 7A is a bottom elevation of the mold assembly of FIG. 6 taken along lines 7A—7A.

Each riser passage 164 terminates in a lowermost end 164*a* adjacent the bottom side 140*b* of the mold stack 140. As shown in FIGS. 6 and 7A, a disposable (e.g., vaporizable plastic foam such as polystyrene) gating system 180 is disposed adjacent the bottom side 140*b* of the mold stack 140 and includes a plurality of runners 182 beneath the lowermost ends 164*a* of the risers 164 and a cross-runner 183 that interconnects the runners 182 to a central depending sprue portion 184. A ceramic fill tube 186 is connected to the lowermost end of the sprue portion 184 as shown in FIG. 6 for immersion in the molten metal pool 13 during casting.

Figure 2:
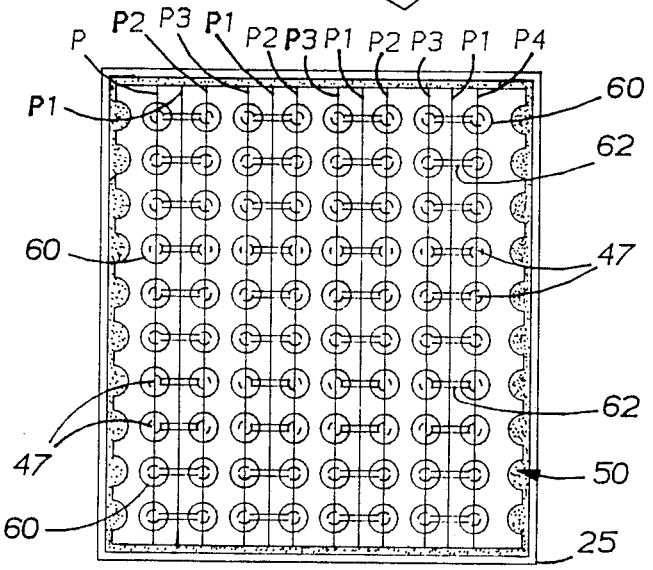
FIG. 2 is a bottom elevation of the mold assembly in the direction of arrows 2—2 of FIG. 1.

The mold stack 140 is supported in a container 122 similar to that described hereinabove with respect to FIGS. 1 and 2. In particular, the container includes an upper vacuum chamber 132 and a lower chamber 134 separated by a gas permeable, particulate barrier 130. The mold stack 140 is supported and sealingly pressed together in the lower chamber 134 by a loose, unbonded particulate bed 150 (e.g., foundry sand) when the upper and lower chambers 132,134 are evacuated in the same manner as described hereinabove for FIGS. 1 and 2. In FIG. 6, it is apparent that the particulate bed 150 extends under the bottom side 140*b* of the mold stack 140 and around the gating system 180 to support them in cooperative relation when the chambers 132,134 are evacuated. The gating system 180 and the mold stack 140 are typically assembled together when the container 122 is inverted (e.g., FIG. 3). The particulate material 152 is introduced in the chamber 134 and compacted around the gating system 180 and the mold stack 140 by evacuation of the chambers 132,134. As a result, there is no need to glue the gating system 180 to the bottom side 140*b* of the mold stack 140. The ceramic fill tube 186 likewise is held in cooperative relation on the sprue portion 184; i.e., by the compacted particulate bed 150.

When the ceramic fill tube 186 is submerged in the molten metal pool 13 with the upper and lower chambers 132,134 evacuated (as described hereinabove with respect to FIGS. 1 and 2), the molten metal is drawn upwardly into the gating system 180 and destroys (vaporizes) the gating system as it moves upwardly. The molten metal eventually moves upwardly into the riser passages 164 and is distributed by lateral ingate passages 163 to the mold cavities 160 to fill them with molten metal.

Figure 8:
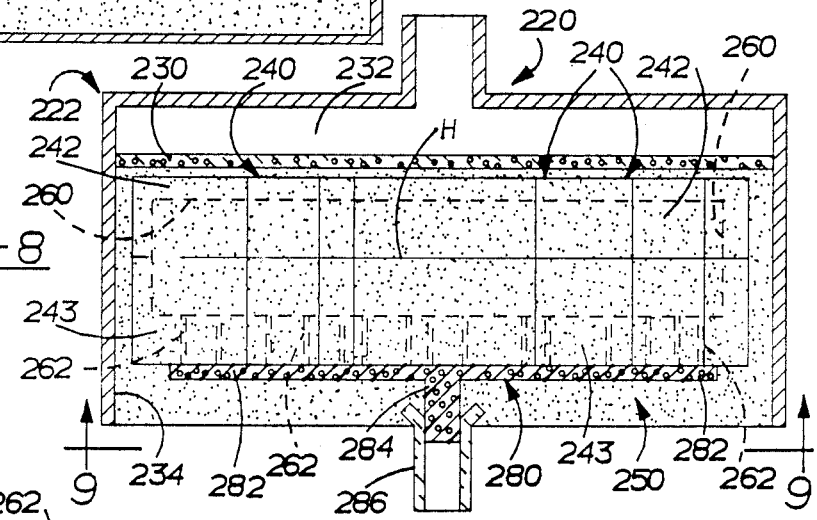
FIG. 8 an elevational view of a mold assembly of another embodiment of the invention positioned in a container, shown in section.
Figure 9:
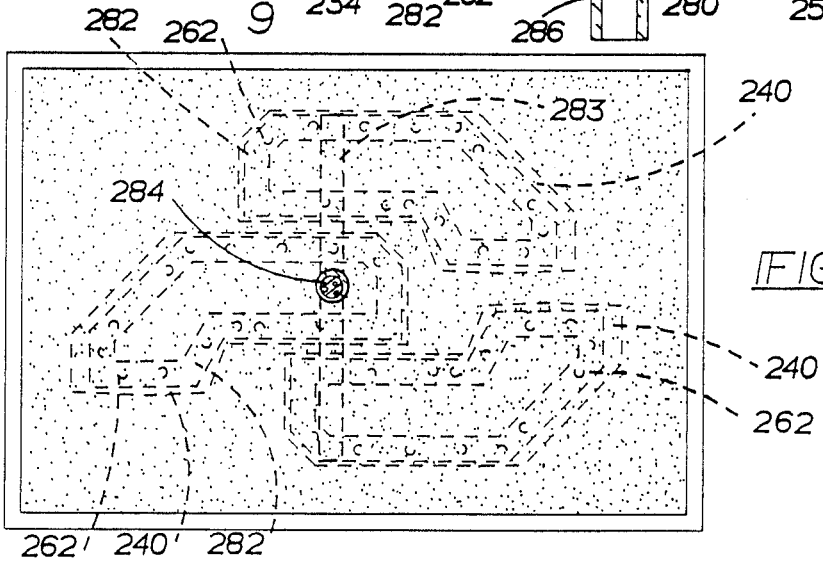
FIG. 9 is a bottom elevational view along lines 9—9 of FIG. 8.

Although the invention has been illustrated hereinabove as employing mold stacks 40(140) having mold members stacked side-by-side and sealingly engaged at vertical parting planes, those skilled in the art will appreciate that the invention is not so limited. Referring to FIGS. 8 and 9, a mold assembly 220 for use in the invention is shown including a container 222 similar to that described hereinabove in having an upper vacuum chamber 232 and a lower chamber 234 separated by a gas permeable, particulate barrier 230. A plurality of individual mold stacks 240 are shown supported in the particulate bed 250 in the manner described hereinabove with the mold members 242,243 pressed sealingly together across the horizontal parting planes H. Each mold stack 240 comprises upper (cope) and lower (drag) gas permeable, self-supporting mold members 242,243 stacked side-by-side at horizontal parting planes H to define an individual mold cavity 260 in each individual mold stack 240. The lower mold member 243 of each mold stack 240 includes a plurality of inlet passages 262 to admit the molten metal to the respective mold cavity 260 thereabove during casting from an underlying molten metal pool. A disposable gating system 280 is positioned beneath each mold stack 240 and includes horizontal runners 282 disposed adjacent and beneath the inlet passages 262 and a cross-runner 283 that interconnects runners 282 with a central depending sprue portion 284. A ceramic fill tube 286 is held on the sprue portion 284 for submersion in the underlying molten metal pool during casting. The particulate bed 250 extends around each mold stack 240 and around the gating system 280 and the fill tube 286 to support them in cooperative relation when the chambers 232,234 are evacuated as described hereinabove for FIGS. 6, 7 and 7A; i.e., by compaction of the particulate bed 350 about these components.

Figure 10:
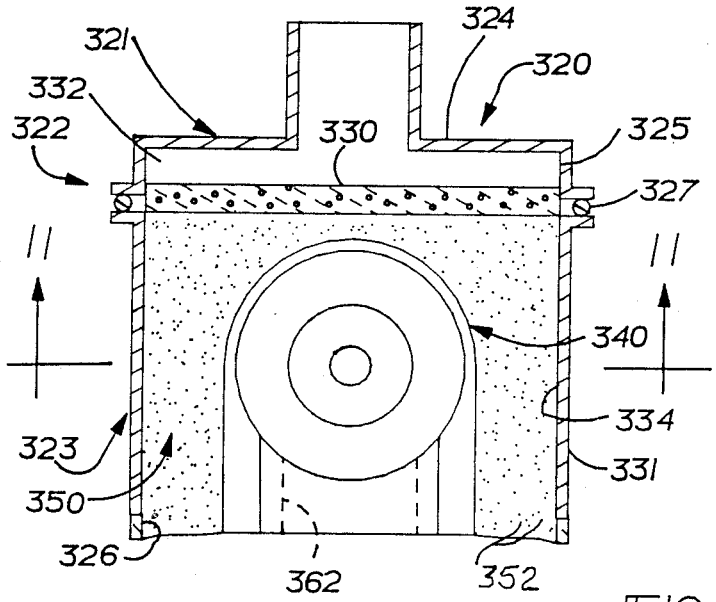
FIG. 10 is an elevational view of a mold assembly of still another embodiment of the invention in a container, shown in section.
Figure 11:
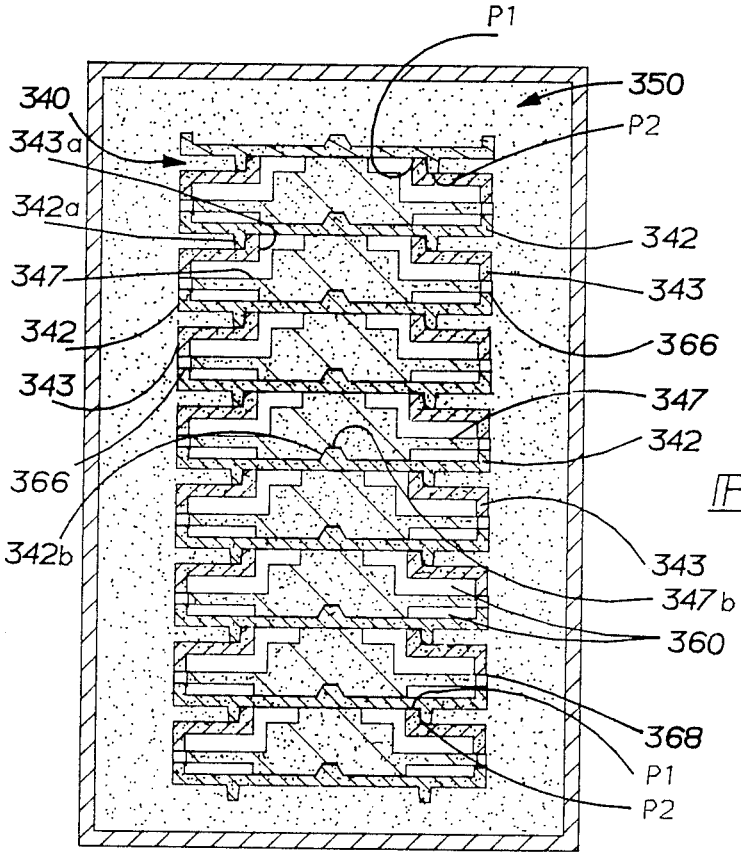
FIG. 11 is a sectional view taken along lines 11—11 of FIG. 10.

FIGS. 10 and 11 illustrate still another embodiment of the invention using a mold assembly 320 that includes a vacuum box 321 and a mold container or flask 323 separable from one another. The vacuum box 321 includes an end wall 324, a peripheral side wall 325 having a sealing gasket 327 fastened thereon and a gas permeable end wall or septum 330 fastened to the peripheral side wall 325. The mold container 323 includes a gas impermeable peripheral side wall 331 having a lowermost ceramic lip 326 for immersion in an underlying molten metal pool, e.g., see FIG. 1. When the vacuum box 321 and the mold container 323 are sealingly engaged (by gasket 327 engaging the upper end of the peripheral wall 331), a container 322 is formed similar to that described hereinabove with respect to FIGS. 1–7 in having an upper vacuum chamber 332 and a lower chamber 334 separated by a gas permeable particulate barrier 330. The lower chamber 334 includes an open end defined by the ceramic lip 326.

As shown best in FIGS. 10 and 11, a mold stack 340 is received and supported in the lower chamber 334 by a bed 350 of loose, unbonded particulate material 352 (e.g., foundry sand). The mold stack 340 includes a plurality of gas permeable self-supporting mold members 342,343 (e.g., resin-bonded sand) stacked side-by-side at vertical parting planes P1,P2 therebetween. Self-supporting cores 347, which may be gas permeable or impermeable, are positioned in core prints 366 formed between the mold members 342,344 as shown in FIG. 11.

The mold members 342,343 and the cores 347 form a plurality of mold cavities 360 as well as a slot-like inlet passage 362 beneath each mold cavity 360 for admitting molten metal thereto during casting.

As shown best in FIG. 11, the mold members 342,343 include respective annular rims **342*a*,343*a* which interfit with one another to effect proper alignment of the mold members in the mold stack 340. Similarly, each mold member 342 includes an alignment nose 342*b* received in a complementary-shaped recess 347*b* formed in the adjacent core 347** for alignment purposes.

Figure 12A:
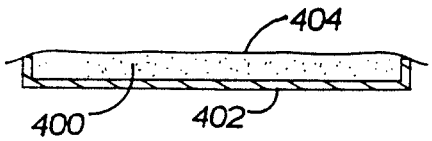
FIGS. 12(A)–12(H) are partially sectioned elevational views illustrating the method of the invention as practiced using the mold assembly shown in FIGS. 10 and 11.
Figure 12B:
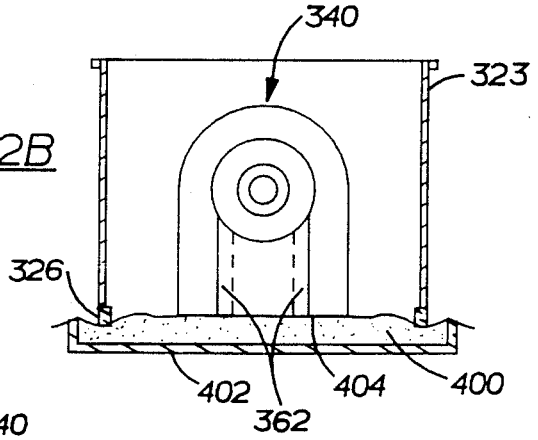
Figure 12C:
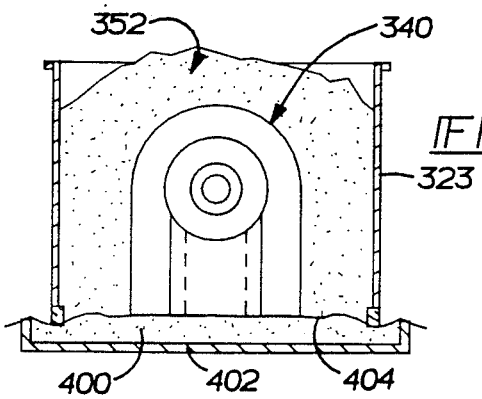
Figure 12D:
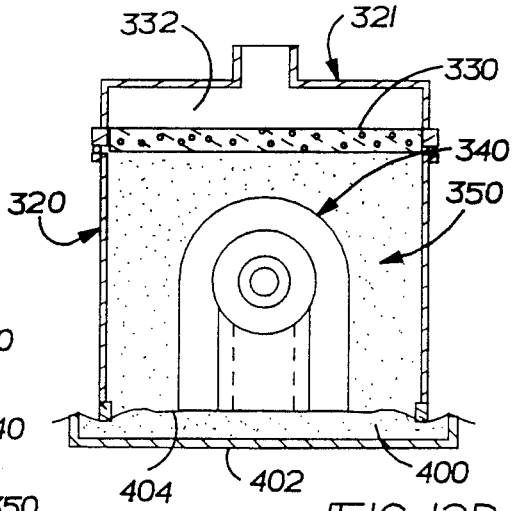
Figure 12E:
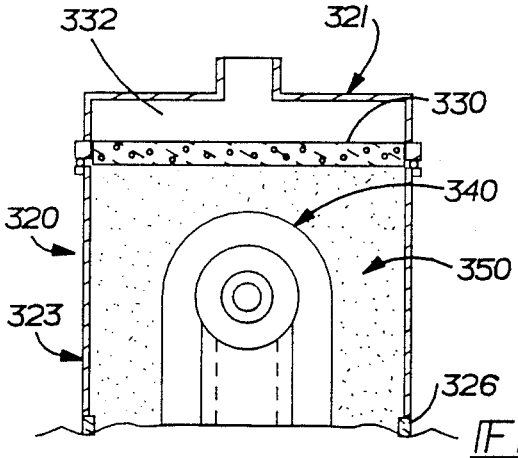
Figure 12F:
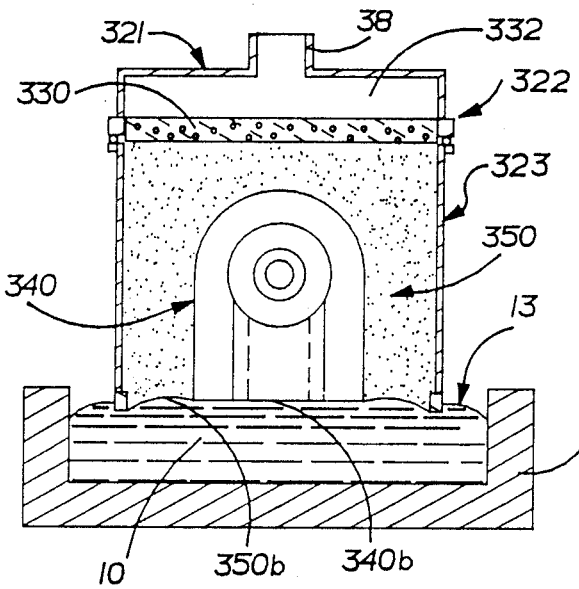
Figure 12G:
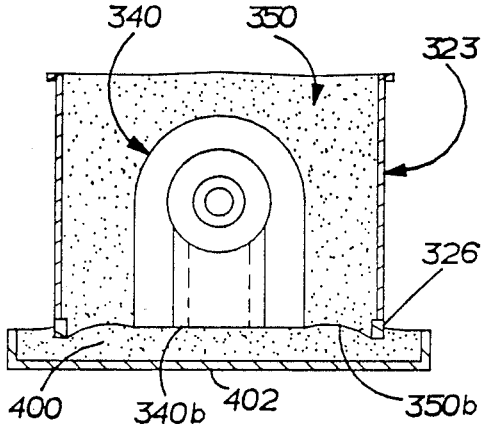
Figure 12H:
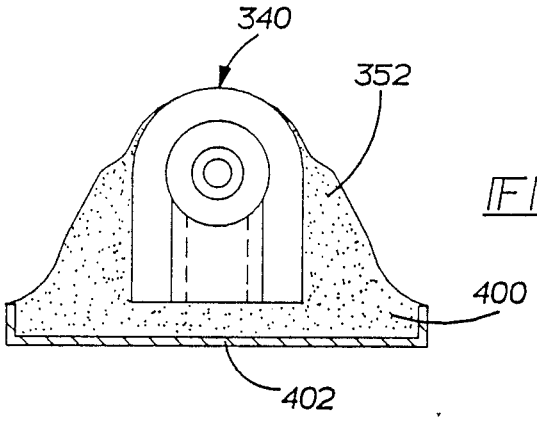

FIGS. 12(A)–12(H) illustrate a method of forming the mold assembly 320 of FIGS. 10 and 11 and carrying out the countergravity casting process using the mold assembly 320. Referring to FIG. 12(A), a dry sand bed 400 is provided in a shallow box 402 with a plastic sheet 404 overlying the bed 400. The mold container 323 is placed on the plastic sheet 404 with the ceramic lip 326 contacting the plastic sheet 404, FIG. 12(B). The mold stack 340 with the mold members 342,343 held together in stacked side-by-side relation by a suitable fixturing means is placed on the plastic sheet 404 with the inlet passages 362 adjacent the plastic sheet 404. Loose, unbonded particulate material 352 (e.g., dry foundry sand) is introduced into the mold container 323, FIG. 12(C) to an appropriate level to maintain the mold members 342,343 together at the parting planes P1,P2, the fixturing means (not shown) holding the mold members 342,343 together may optionally be removed and then additional particulate material 352 is added and leveled with the upper end of the mold container 323. The vacuum box 321 is then attached to the upper end of the mold container 323 with the porous gas permeable septum 330 adjacent the leveled surface of the particulate bed 350. A vacuum is drawn in the upper chamber 332 through conduit 338 sufficient to hold the vacuum box 321 and the mold container 323 together and also sufficient to compact the bed 350 about the mold stack 340 and coact with the bed 350 in supporting and pressing the mold members 342,343 together in the chamber 334 to form the mold assembly 320, FIG. 12(D). The mold assembly 320 is then lifted from the sand bed 400, FIG. 12(E). The plastic sheet 404 is retained against the bottom **350*b* of particulate bed 350 by the negative differential pressure resulting from evacuation of chambers 332,334. As shown in FIG. 12(F), the bottom side 340*b* of the mold stack 340 and the bottom side 350*b* of the particulate bed 350 are submerged in the underlying molten metal pool 13 to carry out the countergravity casting process. The plastic sheet 404 is vaporized as the bottom sides 340*b*, 350*b* are submerged in the pool 13 to expose inlet passages 362 directly to the molten metal pool. After the mold cavities 360 are filled with the molten metal, the mold assembly 320 is raised away from the pool 13 and returned to the sand bed 400, FIG. 12(G) with bottom sides 340*b*,350*b* resting on the bed 400. The vacuum in the upper chamber 334 is then released and the vacuum box 321 is separated from the mold container 323. The molten metal in the mold cavities (e.g., mold cavities 360 shown in FIG. 11) solidifies in the mold stack 340 supported on the sand bed 400. After the molten metal solidifies, the mold container 323 is separated from the particulate bed 350 and the metal-filled mold stack 340 as shown in FIG. 12(H). The castings (not shown) can then be separated from the mold stack 340**.

The vacuum countergravity casting process and apparatus of the invention described hereinabove offer numerous advantages and benefits. In particular, the use of the compactible particulate bed (e.g., 50,150, etc.) to support the gas permeable, self-supporting mold (e.g., mold stack 40,140, etc.) in the inverted casting position during the casting operation permits use of thinner mold walls and consequent savings in the amount of expensive resin-bonded particulate required to form the mold. Generally speaking, much less resin-bonded sand is required to practice the invention as compared, for example, to amount of resin-bonded sand used in the methods described in U.S. Pat. Nos. 4,340,108 and 4,616,691. As much as a 75.9% reduction in the amount of resin-bonded sand used has been achieved.

Moreover, use of a particulate bed (e.g., 50,150, etc.) compacted about the mold eliminates the need for separate sealing gaskets between the mold and the container 22 as well as the need to form sealing flanges/surfaces on the mold. The particulate bed 50 is also capable of accommodating and supporting irregular mold shapes and myriad gating systems for supplying the molten metal to the mold. As a result, a wide variety of mold designs can be used in practicing the invention. For example, mold designs such as the mold stacks (e.g., 40,140, etc.) described and illustrated hereinabove having a large number of mold cavities disposed in a given volume can be used to greatly increase the number of castings which can be vacuum countergravity cast per mold (per mold stack). Moreover, mold designs having the most efficient arrangement of mold cavities on both faces of the intermediate mold members as well as gating systems and risers can be accommodated to significantly reduce the amount of mold material as well as metal (in the gating system) needed to produce the desired number of castings.

Since the particulate bed is compacted about and surrounds the mold in the casting apparatus, molten metal leakage from the mold cavities out of the parting planes is substantially prevented. If any leakage occurs, the molten metal is confined to the vicinity of the mold by the particulate bed, thereby preventing damage to the casting apparatus.

In the preferred embodiment of the invention wherein the mold members are held stacked side-by-side solely by the particulate bed compacted thereabout, there is no need to glue the adjacent mold members at the parting planes therebetween. Elimination of the need to glue the mold members improves mold dimensional control and reduces the cost and complexity of the casting process. Moreover, the mold and a gating system can be held in cooperative relation without the need to glue them together using only the compacted particulate bed therearound.

While the invention is preferably practiced using an inherently unstable bed (e.g., 50,150 etc.) of loose, unbonded particulate material (e.g., 52,152, etc.) compacted about the mold, the invention my also be practiced using a bed of bonded or partially bonded particulate material (e.g., green sand) which is compacted in the container about the mold by various conventional means including sand ramming, sand slinging or similar operations.

Figure 13:
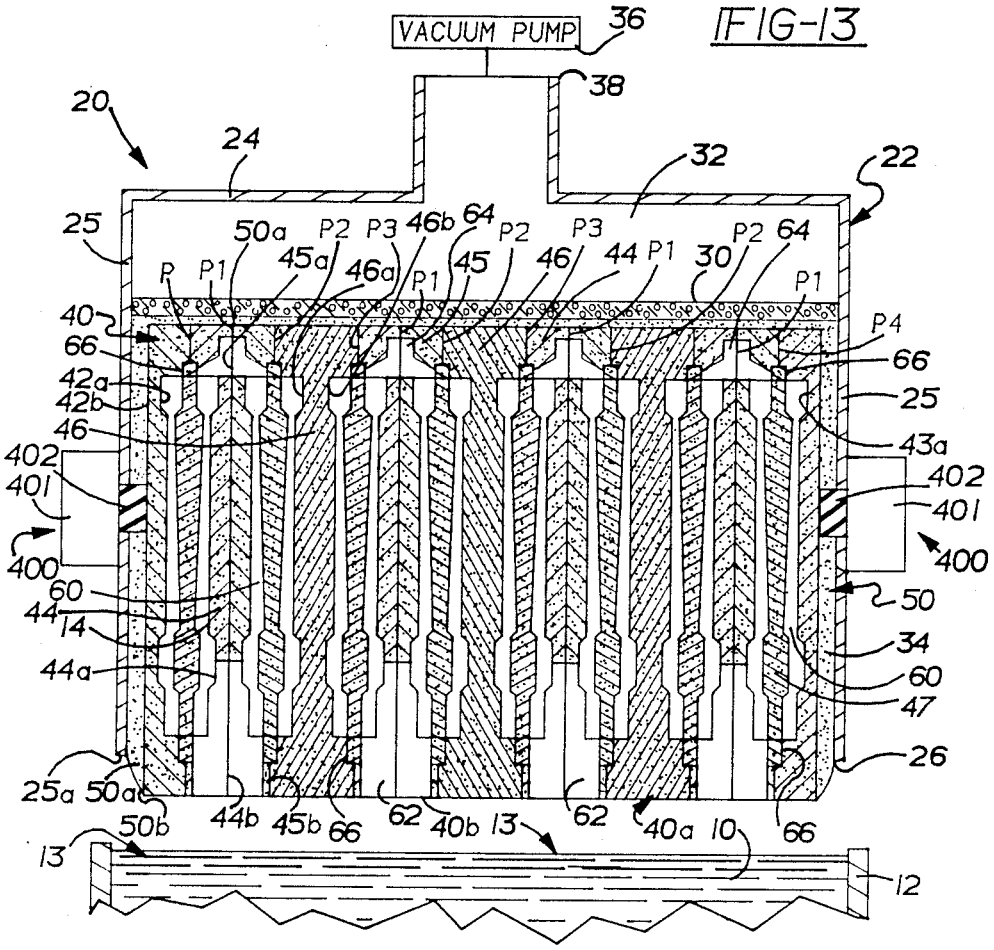
FIG. 13 is a view similar to FIG. 1 of another embodiment of the invention with the addition of separate mold support mechanisms mounted on the container to support the mold inside the container with the particulate bed compacted about the mold.

In the detailed description provided hereinabove, the mold (e.g., mold stack 40,140,etc.) is disposed in the particulate bed (e.g., 50,150,etc.) which is compacted about the mold in the lower chamber (e.g., 34,134,etc.) and which coacts with the negative differential pressure applied between the inside and the outside of the lower chamber to solely support the mold in the inverted casting position before, during and after filling of the mold with the molten metal. Although less preferred, those skilled in the art will appreciate that it is possible to support the mold (e.g., mold stack 40,140,etc.) in the inverted casting position in the lower chamber (e.g., 34,134,etc.) using one or more separate, mold support mechanisms which may be mounted and carried on the container (e.g., 22, 122,etc.). For example, as shown in FIG. 13 (which is similar to FIG. 1 and includes like reference numerals for like features) such mold support mechanisms 400 (shown schematically) may be mounted on the peripheral side wall 25 of the container 22 and include cylinders 401 and fluid actuated pistons 402 adapted in their extended positions to engage, press together and hold the mold stack 40 in the lower chamber 34 before, during and after casting. In this embodiment of the invention, the loose particulate bed 50 is compacted in situ about the mold stack 40 and held in the lower chamber 34 about the mold stack 40 before, during and after casting by virtue of the negative pressure differential established between the inside and the outside of container. The pistons 402 can be retracted toward their respective cylinder 401 to release the metal-filled mold stack 40 at an unloading station after casting such that the metal-filled mold stack 40 and the particulate bed 50 can fall by gravity out of the downwardly facing open end 26 of the container 22 when the pressure inside and outside the container is equalized as explained hereinabove. Those skilled in the art will appreciate that other mechanisms may be used to support the mold stack 40 in the chamber 34 with the particulate bed 50 compacted about the mold stack 40.

While the invention has been described in terms of specific preferred embodiments thereof, it is not intended to be limited thereto but rather only to the extent set forth hereafter in the following claims.

I claim:

1. Apparatus for countergravity casting of molten metal, comprising:

(a) a container having an open bottom end, (b) a gas permeable, self-supporting mold disposed in the container, said mold including a mold cavity and molten metal inlet means communicating with the underside of said mold for admitting the molten metal into the mold cavity from an underlying molten metal pool, (c) a particulate bed compacted in the container about the mold, and (d) means for establishing a negative differential pressure between the inside and the outside of the container sufficient to hold the particulate bed about the mold before, during and after filling of the mold cavity with metal.

2. Apparatus for countergravity casting of molten metal, comprising:

(a) a container having an open bottom end, (b) a gas permeable, self-supporting mold disposed in the container, said mold including a mold cavity and molten metal inlet means communicating with the underside of said mold for admitting the molten metal into the mold cavity from an underlying molten metal pool, (c) a particulate bed disposed in the container about the mold, and (d) means for establishing a negative differential pressure between the inside and the outside of the container sufficient to compact the particulate bed about the mold and hold the particulate bed about the mold before, during and after filling of the mold cavity with metal.

3. Apparatus for countergravity casting of molten metal, comprising:

(a) a container having an open bottom end, (b) a gas permeable, self-supporting mold disposed in the container, said mold including a mold cavity and molten metal inlet means communicating said mold cavity with the underside of said mold for admitting the molten metal into the mold cavity from an underlying molten metal pool, (c) a particulate bed compacted in the container about the mold, and (d) means for establishing a negative differential pressure between the inside and the outside of the container sufficient to so coact with the particulate bed as to support the mold in the container before, during and after filling of the mold cavity with metal.

4. Apparatus for countergravity casting of molten metal, comprising:

(a) a container having an open bottom end, (b) a gas permeable, self-supporting mold disposed in the container, said mold including a mold cavity and molten metal inlet means communicating with the underside of said mold for admitting the molten metal into the mold cavity from an underlying molten metal pool, (c) a compactible particulate bed disposed in the container about the mold, and (d) means for establishing a negative differential pressure between the inside and outside of the container sufficient to compact the particulate bed about the mold and so coact with the particulate bed as to support the mold in the container before, during and after filling of the mold cavity with metal.

5. The apparatus of claim 4 wherein the particulate bed comprises loose, substantially binderless particulate.

6. The apparatus of claim 4 wherein the means for establishing the negative differential pressure comprises means for evacuating the container.

7. The apparatus of claim 4 wherein the container includes an upper vacuum chamber and a lower chamber for receiving the mold and the particulate bed, said upper and lower chambers being separated one from the other by a gas permeable septum substantially impervious to particulates comprising said bed.

8. The apparatus of claim 4 wherein the underside of the mold and the particulate bed are in proximity to the open bottom end of the container for immersion in the underlying molten metal pool.

9. Apparatus for countergravity casting of molten metal, comprising:

(a) a container comprising a peripheral wall defining a chamber having an open bottom end, (b) a mold stack disposed in the chamber, said mold stack including (a) a plurality of gas permeable, self-supporting mold members stacked side-by-side in the chamber and forming a mold cavity therebetween and (b) molten metal inlet means communicating said mold cavity with the underside of said mold stack for admitting the molten metal into the mold cavity from an underlying molten metal pool, (c) a compactible particulate bed disposed in the container about the mold stack, (d) means for holding the mold members stacked together side-by-side in the particulate bed, and (e) means for establishing a negative differential pressure between the chamber and the outside of the container sufficient to compact the particulate bed about the mold stack and so coact with the bed as to support the mold stack in the container before, during and after the mold cavity is filled with the molten metal.

10. The apparatus of claim 9 wherein said mold stack comprises at least one intermediate mold member disposed between two end mold members, said intermediate mold member having oppositely facing parting faces and at least one mold cavity formed at least in part in each of said parting faces.

11. The apparatus of claim 9 wherein said means for holding the mold members stacked side-by-side in the container comprises adhesive between the mold members.

12. The apparatus of claim 9 wherein said means for holding the mold members stacked side-by-side in the container comprises means for pressing the mold members together from the exterior thereof.

13. The apparatus of claim 12 wherein said means for pressing the mold members together comprises the particulate bed compacted about the mold stack by said negative differential pressure.

14. The apparatus of claim 9 wherein the mold members form a substantially vertical parting plane therebetween.

15. The apparatus of claim 9 wherein the molten metal inlet means comprises an inlet passage formed between the mold members.

16. The apparatus of claim 9 wherein the molten metal inlet means includes a sprue depending from the underside of the mold stack.

17. The apparatus of claim 9 wherein the mold members comprise resin-bonded sand.

18. The apparatus of claim 9 wherein the particulate material comprises loose, substantially binderless sand.

19. The apparatus of claim 13 wherein the particulate material comprises loose, substantially binderless sand.

20. The apparatus of claim 9 wherein said means for establishing a negative differential pressure comprises means for evacuating the chamber.

21. The apparatus of claim 20 wherein the container includes an upper vacuum chamber and a lower chamber for receiving the mold stack and the particulate bed, said upper and lower chambers being separated one from the other by a gas permeable septum substantially impervious to particulates comprising said bed.

22. The apparatus of claim 9 wherein the mold stack includes a self-supporting core disposed between the mold members.

23. The apparatus of claim 9 wherein the underside of the mold stack and the underside of the particulate bed are in proximity to the open bottom end of the chamber for immersion in the underlying molten metal pool.

24. The apparatus of claim 23 wherein the underside of the mold stack and the underside of the particulate bed are disposed below the open bottom end of the chamber for immersion in the underlying molten metal pool.

25. The apparatus of claim 23 wherein so much of said wall as defines said open bottom end comprises a material resistant to destructive effects of the molten metal to enable immersion of said open bottom end in the underlying molten metal pool.

26. Apparatus for countergravity casting of molten metal, comprising:

(a) a container having an open bottom end, (b) a mold stack disposed in the container, said mold stack including (a) a plurality of gas permeable, self-supporting mold members stacked side-by-side in the container and forming a mold cavity therebetween and (b) molten metal inlet means communicating the mold cavity with the underside of said mold stack for admitting the molten metal into the mold cavity from an underlying molten metal pool, (c) a compactible particulate bed disposed in the container about the mold stack, and (d) means for establishing a negative differential pressure between the inside and the outside of the container sufficient to compact the particulate bed about the mold stack and so coact with the bed as to press the stacked mold members together and support the mold stack in the container before, during and after the mold cavity is filled with the molten metal.

27. The apparatus of claim 26 wherein the mold members are held stacked together in the container solely by the compacted bed.

28. The apparatus of claim 26 wherein said compactible particulate bed comprises a bed of unbonded sand.

29. The apparatus of claim 26 wherein said mold members comprise bonded sand mold members.

30. The apparatus of claim 26 wherein said mold members include a substantially vertical parting plane therebetween.

31. The apparatus of claim 26 wherein said mold members include a substantially horizontal parting plane therebetween.

32. An apparatus for countergravity casting of molten metal, comprising:

(a) a container having an open bottom end, (b) a mold stack disposed in the container, said mold stack including (a) a plurality of gas permeable, self-supporting mold members stacked side-by-side in the container and forming a mold cavity therebetween and (b) bottom molten metal inlet means communicating said mold cavity with the underside of said mold stack for admitting the molten metal into the mold cavity from an underlying molten metal pool, (c) a bed of loose particulate material disposed in the container about the mold stack, and (d) means for establishing a negative differential pressure between the inside and the outside of the container sufficient to compact the bed about the mold stack so as to press the stacked mold members together and support the mold stack in the container before, during and after the mold cavity is filled with the molten metal.

33. The apparatus of claim 32 wherein the particulate bed comprises binderless sand and the mold members comprise resin-bonded sand.

34. The apparatus of claim 32 wherein said mold members which are inboard the ends of the stack each have a first parting face on one end thereof and a second parting face on the other end thereof opposite said first parting face and have a plurality of partial mold cavities formed in said parting faces.

35. The apparatus of claim 34 wherein the first parting face of one mold member abuts the second parting face of the next adjacent mold member in the stack such that their respective partial mold cavities are registered one with the other to form complete mold cavities.

36. Apparatus for countergravity casting of molten metal, comprising:

(a) a container comprising a peripheral wall defining a chamber having an open bottom end, (b) a mold stack disposed in the chamber, said mold stack including (a) a plurality of gas permeable, self-supporting mold members stacked side-by-side in the chamber at a vertical parting plane therebetween and forming a mold cavity therebetween and (b) molten metal inlet means communicating said mold cavity with the underside of said mold stack for admitting the molten metal into the mold cavity from an underlying molten metal pool, (c) a particulate bed compacted in the chamber about the mold stack and (d) means for establishing a negative differential pressure between the inside and the outside of the chamber sufficient to hold the particulate bed about the mold stack before, during and after filling of the mold cavity with metal.

37. A method of countergravity casting of molten metal, comprising:

(a) positioning a gas-permeable, self-supporting mold in a container having an open end, said mold having a mold cavity therein and molten metal inlet means communicating said mold cavity with the underside of said mold, (b) compacting a particulate bed about said mold in said container, (c) establishing a sufficient negative differential pressure between the inside and the outside of the container to hold the particulate bed in the container about the mold when the open end thereof faces an underlying molten metal pool, (d) orienting the container such that the open end of the container and said molten metal inlet means of the mold face said pool, (e) relatively moving the underlying molten metal pool and the container to immerse said molten metal inlet means in said pool, and (f) drawing the molten metal upwardly through the molten metal inlet means into said mold cavity to fill said mold cavity with said molten metal when the molten metal inlet means is immersed in the pool.

38. A method of countergravity casting of molten metal, comprising:

(a) positioning a gas-permeable, self-supporting mold in a container having an open end, said mold having a mold cavity therein and molten metal inlet means communicating said mold cavity with the underside of said mold, (b) disposing a compactible particulate bed about said mold in said container, (c) establishing a negative differential pressure between the inside and the outside of the container sufficient to compact the particulate bed about the mold and hold the particulate bed in the container about the mold when said open end faces an underlying molten metal pool, (d) orienting the container such that the open end of the container and said inlet means of the mold face said pool, (e) relatively moving the underlying molten metal pool and the container to immerse said inlet means in said pool, and (f) drawing the molten metal upwardly through the inlet means into said mold cavity to fill said mold cavity with said molten metal when the inlet means is immersed in the pool.

39. A method of countergravity casting of molten metal, comprising:

(a) positioning a gas-permeable, self-supporting mold in a container having an open end, said mold having a mold cavity therein and molten metal inlet means communicating said cavity with the underside of said mold, (b) compacting a particulate bed about said mold in said container, (c) establishing sufficient negative differential pressure between the inside and the outside of the container to cause the particulate bed to support the mold in the container when the open end thereof faces an underlying molten metal pool, (d) orienting the container such that the open end of the container and said inlet means face said pool, (e) relatively moving the underlying molten metal pool and the container to immerse the inlet means in said pool, and (f) drawing the molten metal upwardly through the inlet means into said mold cavity to fill said mold cavity with said molten metal when the bottom inlet means is immersed in the pool.

40. The method of claim 39 wherein the said bed comprises substantially unbonded particulates compacted about the mold by said negative differential pressure.

41. The method of claim 39 including the further step of relatively moving the container and the pool to remove the inlet means from the pool, while maintaining sufficient negative differential pressure to cause said bed to support the metal-filled mold in the container.

42. A method of countergravity casting of molten metal, comprising:

(a) positioning a gas-permeable, self-supporting mold in a container having an open end, said mold having a mold cavity therein and molten metal inlet means communicating said mold cavity with the underside of said mold, (b) disposing a compactible particulate bed about said mold in said container, (c) establishing a negative differential pressure between the inside and the outside of the container sufficient to compact the particulate bed about the mold and so coact with the compacted bed as to support the mold in the container when the open end thereof faces an underlying molten metal pool, (d) orienting the container such that the open end of the container and said inlet means of the mold face said pool, (e) relatively moving the underlying molten metal pool and the container to immerse said inlet means in said pool, (f) drawing the molten metal upwardly through the inlet means into said mold cavity to fill said mold cavity with said molten metal when the inlet means is immersed in the pool, and (g) subsequently terminating said negative differential pressure so as to discharge said mold and particulate bed from said container.

43. A method for countergravity casting of molten metal, comprising:

(a) disposing a compactible particulate bed about a mold stack in a container having an open end, said mold stack including a plurality of mold members stacked side-by-side forming a mold cavity and including molten metal inlet means communicating the mold cavity with the underside of said mold stack for admitting the molten metal into the mold cavity, (b) holding the mold members stacked together side-by-side in the particulate bed, (c) establishing a negative differential pressure between the inside and the outside of the container sufficient to compact the particulate bed about the mold stack and so coact with the bed as to support the mold stack in the container when the open end thereof faces an underlying molten metal pool, (d) orienting the container such that the open end of the container and the molten metal inlet means of the mold stack face the underlying molten metal pool, (e) relatively moving the underlying molten metal pool and the container to immerse the molten metal inlet means in said pool, and (f) drawing the molten metal upwardly through the inlet means into the mold cavity in the mold stack to fill said mold cavity with said molten metal when the bottom inlet means is immersed in the pool.

44. The method of claim 43 including adhesively holding said mold members together.

45. The method of claim 43 including pressing said mold members together from the exterior thereof.

46. The method of claim 45 wherein said pressing is effected by compacting the particulate bed about the mold stack.

47. The method of claim 46 wherein said compacting is effected by establishment of said negative differential pressure.

48. The method of claim 43 including the further step of relatively moving the container and the pool to remove the molten metal inlet means from the pool after the mold cavity is filled with the molten metal while maintaining said negative differential pressure sufficient to so coact with said compacted particulate bed as to press the mold members together and support the metal-filled mold stack in the container.

49. The method of claim 48 including the step of subsequently terminating said negative differential pressure so as to discharge said mold and particulate bed from said container.

50. A method for countergravity casting of molten metal, comprising:

(a) disposing a compactible particulate bed about a mold stack in a container having an open end, said mold stack including a plurality of gas permeable, self-supporting mold members stacked side-by-side forming a mold cavity therebetween and including molten metal inlet means communicating the mold cavity with the underside of said mold stack for admitting the molten metal into the mold cavity, (b) establishing a negative differential pressure between the inside and the outside of the container sufficient to compact the particulate bed about the mold stack and so coact with the particulate bed as to press the stacked mold members together and support the mold stack in the container when the open end thereof faces an underlying molten metal pool, (c) orienting the container such that the open end of the container and a the molten metal inlet means of the mold stack face the molten metal pool, (d) relatively moving the underlying molten metal pool and the container to immerse the molten metal inlet means in said pool, and (e) drawing the molten metal upwardly through the bottom inlet means into the mold cavity to fill said mold cavity with said molten metal when the bottom inlet means is immersed in the pool.

51. The method of claim 50 including the further step of relatively moving the container and the pool to remove the molten metal inlet means from the pool after filling of the mold cavity with the molten metal, while maintaining said negative differential pressure to so coact with said particulate bed as to press the mold members together and support the metal-filled mold stack in the container.

52. The method of claim 50 wherein in step (b) the mold members are pressed together across a substantially vertical parting plane therebetween.

53. A method for countergravity casting of molten metal, comprising:

(a) disposing a bed of loose particulate about a mold stack in a container having an open end, said mold stack including a plurality of gas permeable, self-supporting mold members stacked side-by-side forming a mold cavity therebetween and including molten metal inlet means communicating the mold cavity with the underside of said mold stack for admitting the molten metal to the mold cavity, (b) establishing a negative differential pressure between the inside and the outside of the container sufficient to compact the bed about the mold stack and so coact with the bed as to press the stacked mold members together and support the mold stack in the container when the open end thereof faces an underlying molten metal pool, (c) orienting the container such that the open end of the container and the molten metal inlet means of the mold stack face the molten metal pool, (d) relatively moving the underlying molten metal pool and the container to immerse the molten metal inlet means in said pool, and (e) drawing the molten metal upwardly through the molten metal inlet means into the mold cavity to fill said mold cavity with said molten metal when the molten metal inlet means is immersed in the pool.

54. The method of claim 53 wherein the loose particulate material comprises loose sand.

55. The method of claim 54 including the further step of relatively moving the container and the pool to remove the molten metal inlet means from the pool after filling the mold cavity with the molten metal, while maintaining said negative differential pressure to so coact with said compacted particulate bed as to press the mold members together and support the metal-filled mold stack in the container.

* * * * *